US006407036B1

(12) United States Patent
Midorikawa et al.

(10) Patent No.: US 6,407,036 B1
(45) Date of Patent: Jun. 18, 2002

(54) THERMAL RECORDING MATERIAL

(75) Inventors: Yoshimi Midorikawa; Naomi Sumikawa; Yuji Tsuzuki; Tomoniri Sekine; Kaoru Hamada; Yoshihide Kimura, all of Tokyo (JP)

(73) Assignee: Nippon Paper Industries Co. Ltd, Tokyo (JP)

( * ) Notice: Subject to any disclaimer, the term of this patent is extended or adjusted under 35 U.S.C. 154(b) by 0 days.

(21) Appl. No.: 09/674,299

(22) PCT Filed: Mar. 3, 2000

(86) PCT No.: PCT/JP00/01299

§ 371 (c)(1),
(2), (4) Date: Oct. 31, 2000

(87) PCT Pub. No.: WO00/53425

PCT Pub. Date: Sep. 14, 2000

(30) Foreign Application Priority Data

| | | |
|---|---|---|
| Mar. 5, 1999 | (JP) | 11-058114 |
| May 31, 1999 | (JP) | 11-151596 |
| May 28, 1999 | (JP) | 11-149466 |
| Aug. 24, 1999 | (JP) | 11-236556 |

(51) Int. Cl.[7] ..... B41M 5/30
(52) U.S. Cl. ..... 503/209; 503/216; 503/221
(58) Field of Search ..... 503/208, 209, 503/216, 221

(56) References Cited

PUBLICATIONS

Japanese Patent Office, Patent Abstract of Japan, Publication No. 57011088, published Jan. 20, 1982.
Japanese Patent Office, Patent Abstract of Japan, Publication No. 58205793, published Nov. 30, 1983.
Japanese Patent Office, Patent Abstract of Japan, Publication No. 11157220, published Jun. 15, 1999.
Japanese Patent Office, Patent Abstracts of Japan, Publication No. 07223375, published Aug. 22, 1995.
Japanese Patent Office, Patent Abstract of Japan, Publication No. 07186531, published Jul. 25, 1995.
Japanese Patent Office, Patent Abstract of Japan, Publication No. 05168965, published Jul. 2, 1993.
Japanese Patent Office, Patent Abstract of Japan, Publication No. 07223379, published Aug. 22, 1995.
Japanese Patent Office, Patent Abstract of Japan, Publication No. 10264531, published Oct. 6, 1998.
Japanese Patent Office, Patent Abstract of Japan, Publication No. 09314996, published Dec. 9, 1997.
Japanese Patent Office, Patent Abstract of Japan, Publication No. 08118815, published May 14, 1996.
Japanese Patent Office, Patent Abstract of Japan, Publication No. 07172057, published Jul. 11, 1995.
Japanese Patent Office, Patent Abstract of Japan, Publication No. 06336087, published Dec. 6, 1994.
Japanese Patent Office, Patent Abstract of Japan, Publication No. 02301484, published Dec. 13, 1990.
Japanese Patent Office, Patent Abstract of Japan, Publication No. 02258292, published Oct. 19, 1990.

*Primary Examiner*—Bruce H. Hess
(74) *Attorney, Agent, or Firm*—Sherman & Shalloway

(57) ABSTRACT

(1)

(2)

(3)

A thermal recording sheet which is satisfactory in sensitivity in color development, background heat resistance, and background color, is free from powdering, and has excellent image retention. The sheet comprises supporting and formed thereon a thermal color development layer containing as main components a colorless or light-colored basic dye and an organic color developer, and is characterized in that the thermal color development layer contains at least one dihydroxydiphenyl sulfone compound represented by general formula (1) as the organic color developer, and further contains either at least one saturated fatty acid monoamide represented by general formula (2) in an amount of 1.5 to 5 parts per part of the organic color developer or a combination of at least one saturated fatty acid monoamide represented by general formula (2) and at least one diphenyl sulfone derivative represented by the general formula (3). In said formulas, $R_1$ and $R_2$ each represents $C_{1-8}$ alkyl, alkenyl, or halogeno; and a and b each is an integer of 0 to 3; $R_3$ represents $C_{11-21}$ alkyl; and $R_4$ to $R_9$ each represents hydrogen, alkyl, halogeno, nitro, alkoxy, cyano, or allyloxy.

4 Claims, No Drawings

THERMAL RECORDING MATERIAL

BACKGROUND OF THE INVENTION

1. Field of the Invention

The present invention relates to a thermal recording material that has good color developing sensitivity, good resistance to heat and good ground color and not generate powder, further has an excellent image retention.

2. Description of the Prior Art

In general, a thermal recording material having a thermally sensitive color developing layer mainly composed of colorless or pale colored dye precursor and color developing agent that develops color by reacting with said dye precursor when heated is disclosed in Japanese patent publication 45-14039 and widely used in commercial scale. A thermal printer in which a thermal head is installed is used for the recording method of said thermal recording material. Since this kind of thermal recording method superiors to the conventional recording method from the view point of noiseless at recording process, does not need developing and fixing processes, maintenance free, equipment is relatively cheap and compact and the obtained image is very clear, therefore, this method is widely applied in the field of facsimile or computer, various kinds of measuring instrument and for a labeling machine along with the growth of an information industry. The recording devices attached to these instruments are becoming more diversified and more high-performance, and the required quality to the thermal recording material is becoming more severe. Along with the miniaturization of an instrument and requirement for higher recording speed, it becomes necessary to obtain deep and clear color developing image.

For the purpose to meet the requirement, for example, in the Japanese Patent Laid open Publication 56-169087, a method to improve the color developing sensitivity by adding a thermo fusion substance to a thermally sensitive layer is disclosed, and in the Japanese Patent Laid Open Publication 56-144193, a method to improve the color developing sensitivity by using new color developing agent which has high color developing ability is disclosed. However, these methods can not be said to have a sufficient quality, because these methods have defects such as deterioration of ground color by heat, powder generation by aging and dropping of color density after preserved for long time (reprinting ability). Further, the method to use dye, color developing agent together with adequate sensitizer can be used. For example, in a case that the color developing agent is a phenol type compound represented by bisphenol A, p-benzylbiphenyl (Japanese Patent Laid Open Publication 60-82382), p-benzyloxybenzoicbenzyl(Japanese Patent Laid Open Publication 57-201691) or benzylnaphthyleter (Japanese Patent Laid Open Publication 58-87094) can be used as an adequate sensitizer. When a sensitizer is used, the sensitizer is fused in the first place and the fused sensitizer dissolves dye and color developing agent and are mixed by molecular size level so as to cause the color developing reaction, therefore, the selection of the kind of sensitizer, dye and color developing agent is very important.

Dihydroxydiphenylsulfone compound, which is used as an organic color developing agent is a well-known conventional compound, however, the color developing ability of it is too poor to meet the current requirement for high sensitivity. As the method to improve the color developing sensitivity, in Japanese Patent Laid Open Publication 4-69283, a method to add di(p-methylbenzyl)oxalate is disclosed and in Japanese Patent Laid Open Publication 8-67070, a method to add solid solution composed of two types of oxalic acid ester derivatives is disclosed. By said methods, the color developing sensitivity can be improved more or less, however, from the view points of powder generation and image preservation by aging, these methods can not be said as a sufficient ones. As mentioned above, by the conventional thermal sensitive recording medium, it is difficult to meet the current requirement to improve color developing sensitivity, further, is also difficult to meet the other requirements for quality such as to have good heat resistance of ground color, and excellent image preservative stability.

DISCLOSURE OF THE INVENTION

The object of this invention is to provide a thermal recording material which has good color developing sensitivity, strong heat resistance, excellent ground color and does not generate powder, further has excellent image retention.

The inventors of this invention have conduced an intensive study and have found that in a thermal recording material which possesses a thermally sensitive color developing layer containing colorless or pale colored basic dye and an organic color developing agent as main components, the thermal recording material which contains at least one kind of dihydroxydiphenylsulfone type compound represented by following general formula (1) as an organic color developing agent and containing at least one kind of saturated fatty acid monoamide represented by following general formula (2) can solve the above mentioned problems, and accomplished the present invention.

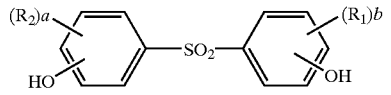

(1)

(in this formula, $R_1$ and $R_2$ is an alkyl group or an alkyl group of carbon number 1–8, or a halogen atom and a and b is an integer number of 0–3)

$$R_3—CONH_2 \quad (2)$$

(in this formula, $R_3$ is an alkyl group of carbon number 11–21)

In general, it is concerned that the velocity of dissolution and diffusion or solubility of the dye into the melted color developing agent give the important effects to the color developing sensitivity of thermal recording material. To improve said effects, the method to add various kinds of material as a sensitizer is carried out. It is concerned that the addition of sensitizer causes several effects such as falling down of melting point, falling down of activated energy, change of polarity, improvement of solubility between each materials, and the velocity for fusing, dissolving and diffusion and saturated solubility are improved. Thus the color developing sensitivity of the thermal recording material can be improved.

In general, waxes containing saturated fatty acid monoamide are widely known as the sensitizer. However, this invention has been accomplished by finding out that the thermal recording material whose color developing sensitivity is improved, has a strong heat resistance and does not generate powder, further has an excellent image retention can be obtained by containing dihydroxydiphenylsulfone compound as an organic color developing agent and containing saturated fatty acid monoamide by the specific limit, that is, 1.5–5 parts to 1 part of dihydroxydiphenylsulfone compound.

Generally, if waxes or a sensitizer are used by large amount to improve the color developing sensitivity, the color developing sensitivity can be improved, however, other problems such as deterioration of heat resistance of ground color or generation of powder occurs. Therefore, the amount of sensitizer is usually 1 part to 1 part of color developing agent. In the meanwhile, the inventors of this invention have found that the use of saturated fatty acid monoamide as a sensitizer can solve said problem. Namely, in this case, even if the amount of saturated fatty acid monoamide to dihydroxydiphenylsulfone compound is bigger than usual, the heat resistance or powder generation are not deteriorated, and high color developing sensitivity can be obtained. The reason why is not clear, however, it is concerned that by the use of saturated fatty acid monoamide the mutual solubility between dye, color developing agent and sensitizer becomes good and color developing sensitivity is improved, and since the remarkable falling down of melting point does not occur, the deterioration of heat resistance is very small. Further, since the saturated fatty acid monoamide is not a sublimate substance, the developed image formed by the reacted product by dye, color developing agent and sensitizer can be stably preserved.

When diphenylsulfone derivatives represented by following general formula (3) is added besides dihydroxydiphenylsulfone compound as an organic color developing agent and saturated fatty acid monoamide, a thermal recording material whose color developing sensitivity is further improved, whose ground color and heat resistance are maintained in the practical level, and has good image preservative property can be obtained. The reason why is not clear, however, it is concerned that even if dihydroxydiphenylsulfone compound, saturated fatty acid monoamide and diphenylsulfone derivatives are contained together, remarkable falling down of melting point does not occur and mutual solubility of each materials is improved.

(3)

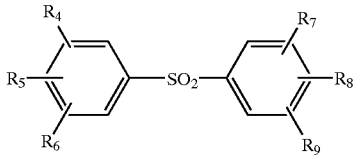

($R_4$–$R_9$ represent a hydrogen atom, an alkyl group, a halogen atom, a nitro group, an alkoxy group, a cyano group and an allyloxy group).

Further, in this invention, when at least one kind of specific compound selected from the group composed of 4-benzyloxy-4'-(2,3-epoxy-2-methyl propoxy) diphenylsulfone, epoxy resin and diphenylsulfone bridgeable type compound are contained, it is recognized that the image preservative property of color developed part is improved. The reason why is not clear, however, it is concerned that said specific compound is bonded with an electro charge transferring complex which is formed by the reaction between dye and color developing agent and becomes more stable state.

[in the formula, X and Y can be different and indicate a saturated or an unsaturated liner or a grafted hydrocarbon group of carbon number 1–12 which can possess an ether bond, or indicate (a)

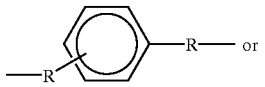

(b)

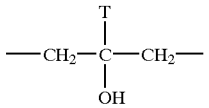

(R indicates a methylene group or an ethylene group, T indicates a hydrogen atom or an alkyl group of carbon number 1–4,)

and $R_{10}$–$R_{15}$ independently indicate a halogen atom, an alkyl group or an alkenyl group of carbon number 1–6, further, m, n, p, q, r, and t indicate an integer number of 0–4 and when are bigger than 2, $R_{10}$–$R_{15}$ can be different, and d is an integer of 0–10]

THE BEST EMBODYMENT TO CARRY OUT THE INVENTION

The thermal sensitive recording medium of this invention, for example, can be produced by following method. That is, prepare the dispersion in which a dye and compounds represented by general formula (1), general formula (2) and general formula (3) and a stabilizer at need are dispersed with a binder, then a filler and other necessary additives are added. Thus the coating for a thermal sensitive color developing layer is prepared. The prepared coating is coated on a substrate and dried up so as to form a thermal sensitive color developing layer. In this invention, dihydroxydiphenylsulfone compound represented by general formula (1) is contained as an organic color developing agent. The concrete example of general formula (1) can be mentioned below. However, not intend to be limited to these compounds.

4,4'-dihydroxydiphenylsulfone (1-1)

2,4'-dihydroxydiphenylsulfone (1-2)

bis-(3-allyl-4-hydroxyphenyl)sulfone (1-3)

3,3'-dimethyl-4,4'-dihydroxydiphenylsulfone (1-4)

3,3',5,5'-tetramethyl-4,4'-dihydroxydiphenylsulfone (1-5)

2,2'-bis(4-chrolophenol)sulfone (1-6)

4-hydroxyphenyl-3'-isopropyl-4'-hydroxyphenylsulfone (1-7)

bis-(3-ethyl-4-hydroxyphenyl)sulfone (1-8)

2,2'-bis(p-t-buthylphenol)sulfone (1-9)

2,2'-bis(p-t-penthylphenol)sulfone (1-10)

2,2'-bis(p-t-octylphenol)sulfone (1-11)

In these compounds, the compounds of (1-1)–(1-3) are desirably use, because of good sensitivity, strong heat (4)

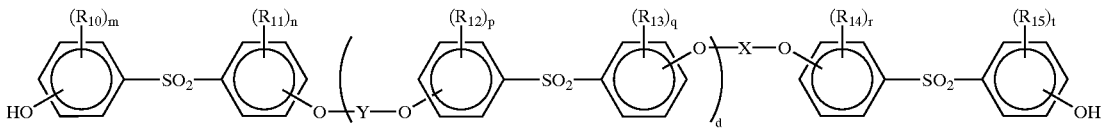

resistance, and easily purchase from the market. These color developing agents can be used alone or together with.

In this invention, saturated fatty acid monoamide represented by general formula (2) is contained. When this saturated fatty acid monoamide is used alone, the amount to be contained is 1.5–5 parts to 1 part of organic color developing agent. In said limit, the thermal recording material which has high color developing sensitivity at the printing of lower energy region can be obtained, maintaining excellent quality level at a heat resistance and a color developing sensitivity without generating powder. Especially, when the amount to be contained is within the limit of 1.7–3.5 parts, a product having more excellent quality can be obtained.

Further, in this invention, diphenylsulfone derivatives represented by general formula (3) can be contained together with saturated fatty acid monoamide represented by general formula (2). In the case that diphenylsulfone derivatives and saturated fatty acid monoamide are used together with, the desirable amount of diphenylsulfone derivatives and saturated fatty acid is respectively 0.25–1.7 parts to 1 part of dihydroxydiphenylsulfone. When the amount to be contained is within said limit, the thermal recording material which is excel in color developing sensitivity, ground color, heat resistance and image preservative property at high humid condition can be obtained. Further, when the amount of both compounds are within 0.5–1.5 parts, image preservative property at high humid condition can be more improved and the product of higher quality can be obtained. The desirable containing ratio of diphenylsulfone derivatives and saturated fatty acid monoamide is 1:3–3:1, and by this ratio, qualities such as color developing sensitivity and heat resistance are desirably balanced.

And, when the containing amount of diphenylsulfone derivatives represented by general formula (3) is smaller than 4% to the total amount of solid part of thermally sensitive coating, the thermally sensitve recording medium that does not generate powder by the printing of high energy can be obtained, maintaining the excellent quality level. Further, if the containing amount of saturated fatty acid monoamide is 1.5–5 parts to 1 part of organic color developing agent, the color developing sensitivity is further improved.

In general formula (2), $R_3$ indicates a hydrocarbon group and concretely, alkyl group of carbon number 11–21 can be mentioned. As the concrete example of compound represented by general formula (2), compounds of (2-1)–(2-4) can be mentioned, but not be intended to be limited to them. Especially, when (2-2) and (2-3) are used together with, good color developing sensitivity and heat resistance are preferably improved. Therefore, the mixture of (2-2) and (2-3) is desirably used.

$$C_{11}H_{23}CONH_2 \quad (2\text{-}1)$$

$$C_{15}H_{31}CONH_2 \quad (2\text{-}2)$$

$$C_{17}H_{35}CONH_2 \quad (2\text{-}3)$$

$$C_{21}H_{43}CONH_2 \quad (2\text{-}4)$$

In general formula (3), $R_4$–$R_9$ can be a substituted group that does not prevent the sensitizer effect, and as the concrete example, hydrogen atom, alkyl group, halogen atom, nitro group, alkoxy group, cyano group and allyloxy group can be mentioned. Especially, hydrogen atom, alkyl group of carbon number 1–6, alkoxy group of carbon number 1–6, halogen atom and nitro group can be mentioned. The concrete examples are mentioned from (3-1) to (3-46) as follows, however, not be intend to be limited to these compounds.

(3-1)

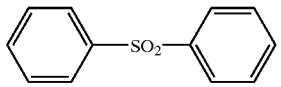

(3-2)

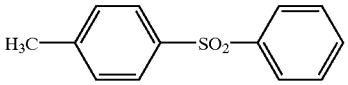

(3-3)

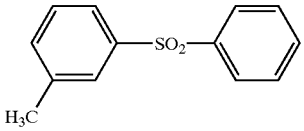

(3-4)

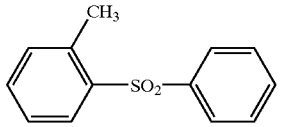

(3-5)

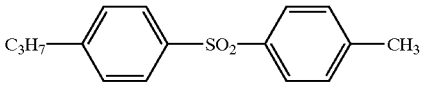

(3-6)

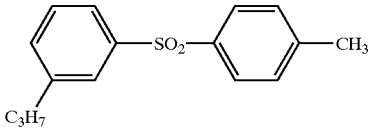

(3-7)

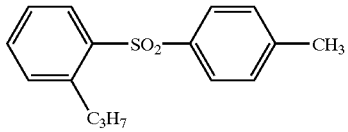

(3-8)

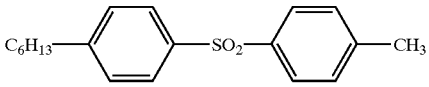

(3-9)

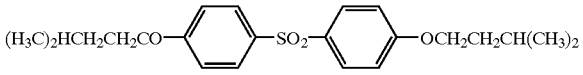

(3-10)

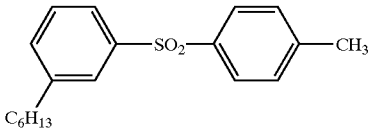

(3-11)

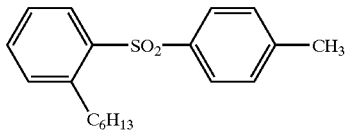

(3-12)

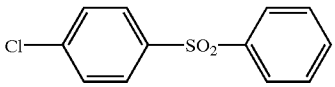

-continued
(3-13)
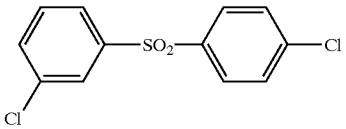
(3-14)
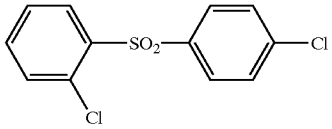
(3-15)
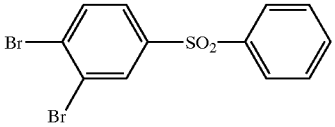
(3-16)
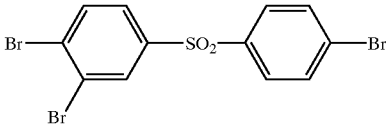
(3-17)
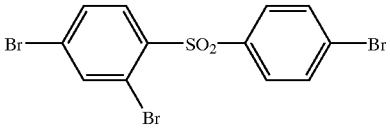
(3-18)
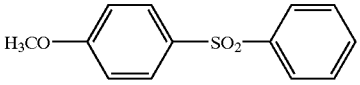
(3-19)
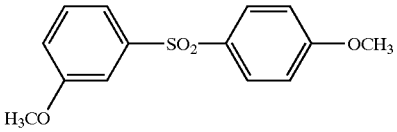
(3-20)
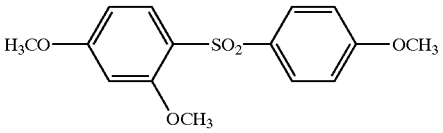
(3-21)
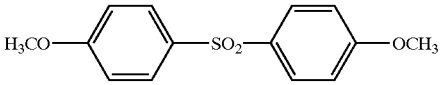
(3-22)
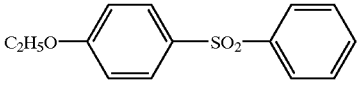
(3-23)
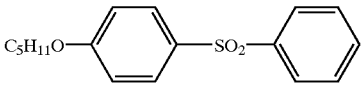
(3-24)
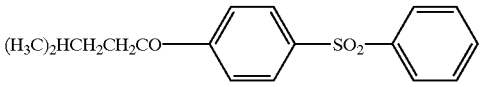
(3-25)
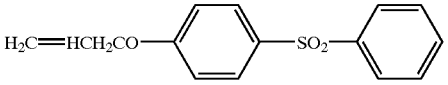
-continued
(3-26)
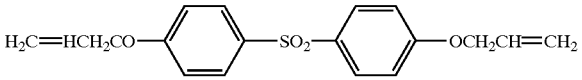
(3-27)
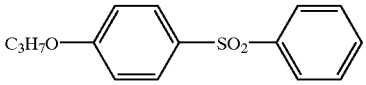
(3-28)
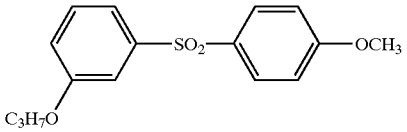
(3-29)
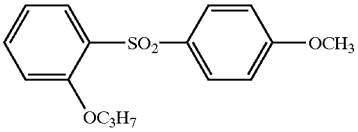
(3-30)
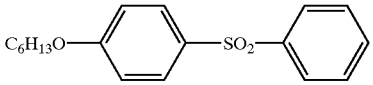
(3-31)
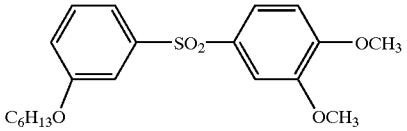
(3-32)
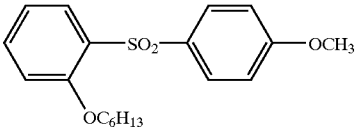
(3-33)
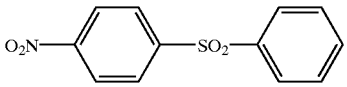
(3-34)
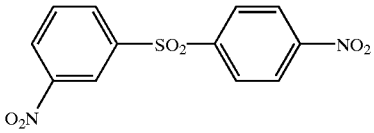
(3-35)
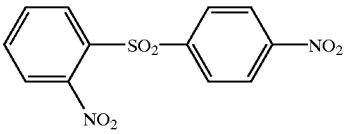
(3-36)
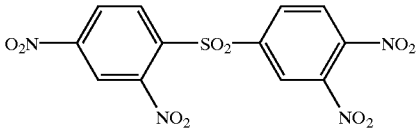
(3-37)
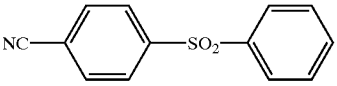

-continued (3-38)

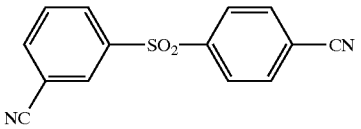

(3-39)

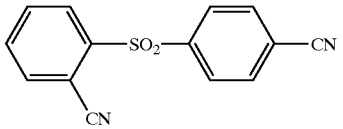

(3-40)

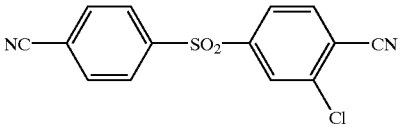

(3-41)

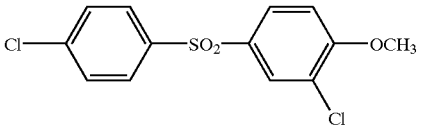

(3-42)

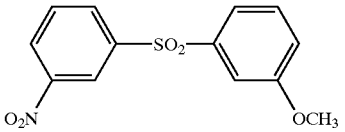

(3-43)

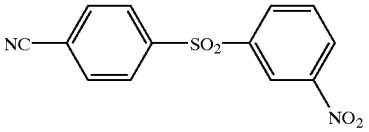

(3-44)

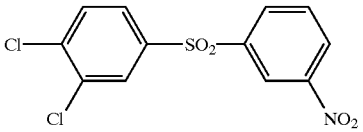

(3-45)

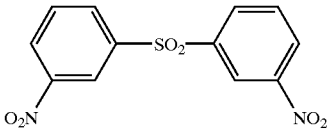

(3-46)

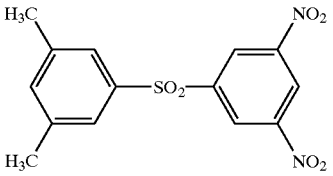

Further, in this invention, 4-benzyloxy-4'-(2,3epoxy-2-methylpropoxy) diphenylsulfone, epoxy resin and diphenylsulfone bridgeable type compound represented by general formula (4) can be contained. If the amount of these compounds is too small to dihydroxydiphenylsulfone compound represented by general formula (1), the image stabilizing effect is not sufficient, and if too much, sensitivity and heat resistance are deteriorated. In this invention, it is desirable to use 0.01 to 0.9 parts of these compounds to 1 part of dihydroxydiphenylsulfone compound. Especially, if exceed 0.17 parts, the image preservative property to plasticizer can be improved.

As the epoxy resin, bisphenol A type epoxy resin, phenol novolak type epoxy resin, cresol novolak type epoxy resin and copolymer of glicidylmethacrylate and vinyl monomer can be mentioned. Among these compounds, the copolymer of glicidylmethacrylate and vinyl monomer can be desirably used because of good effect as a stabilizer and excellent heat resistance. Further, the copolymer of glicidylmethacrylate and vinyl monomer whose average molecular weight is 9000–11000, epoxy equivalent is 300–600 and melting point is lower than 110° C.

The diphenylsulfone bridgeable type compound represented by general formula (4) is described in Japanese Patent Laid Open Publication 10-29969.

In general formula (4), the concrete examples of groups represented by X and Y are mentioned as follow. That is, methylene group, ethylene group, trimethylene group, tetramethylene group, pentamethylene group, hexamethylene group, heptamethylene group, octamethylene group, nonamethylene group, decamethylene group, undecamethylene group, dodecamethylene group, methylmethylene group, dimethylmethylene group, methylethylene group, methyleneethylene group, ethylethylene group, 1,2-dimethylethylene group, 1-methyltrimethylene group, 1-methyltetramethylene group, 1,3-dimethyltrimethylene group, 1-ethyl4-methyl-tetramethylene group, vinylene group, propenylene group, 2-butenylene group, ethynylene group, 2-butynylene group, 1-vinylethylene group, ethyleneoxyethylene group, tetramethyleneoxytetramethylene group, ethyleneoxyethyleneoxyethylene group, ethyleneoxymethyleneoxyethylene group, 1,3-dioxane-5,5-bismethylene group, 1,2-xylyl group, 1,3-xylyl group, 1,4-xylyl group, 2-hydroxytrimethylene group, 2-hydroxy-2-methyltrimethylene group, 2-hydroxy-2-ethyltrimethylene group, 2-hydroxy-2-propyltrimethylene group, 2-hydroxy-2-isopropyltrimethylene group and 2-hydroxy-2-butyltrimethylene group can be mentioned.

Alkyl or alkenyl group of $R_{10}$–$R_{15}$ is an alkyl group of $C_1$–$C_6$ or an alkenyl group of $C_1$–$C_6$, and as a concrete example, methyl group, ethyl group, n-propyl group, isopropyl group, n-butyl group, sec-butyl group, tert-butyl group, n-pentyl group, isopentyl group, neopentyl group, tert-pentyl group, n-hexyl group, isohexyl group, 1-metylpentyl group, 2-methylpentyl group, vinyl group, allyl group, isopropenyl group, 1-propenyl group, 2-butenyl group, 3-butenyl group, 1,3-butandienyl group and 2-methyl-2-propenyl group can be mentioned. And a halogen atom indicates chloride, bromine, fluorine or iodine.

In this invention, referring to the diphenylsulfone bridgeable type compound represented by general formula (4), several kinds of said compound whose substitution group and/or number of d are different can be used together with. And the mixing ratio is voluntary. And as the mixing method, a mixing method by powder, a mixing method in aqueous dispersion and a method to react several kinds of diphenylsulfone bridgeable type compound simultaneously by controlling reactive condition can be mentioned, however, not intend to be limited to them.

When several kinds of diphenylsulfone bridgeable type compound represented by general formula (4) are used together with, the desirable composition contains more than 2 kinds of compound represented by general formula (5) whose d values only are different. The method for preparation of these kinds of compound is not so difficult, that is, by changing reactive ratio of the starting materials, the compounds whose d values are different can be synthesized simultaneously by voluntary containing ratio.

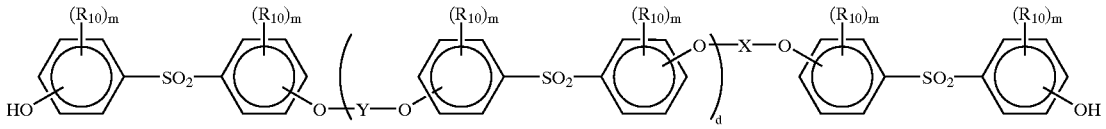

(5)

[in the formula, X, Y, $R_{10}$, m and d are same to above]

As a concrete example of compound represented by general formula (4), following compounds can be mentioned (4-1)

4,4'-bis[4-[4-(4-hydroxyphenylsulfonyl)phenoxy]-2-trans-butenyloxy]diphenylsulfone (4-2)

4,4'-bis[4-(4-hydroxyphenylsulfonyl) phenoxy-4-butyloxy]diphenylsulfone (4-3)

4,4'-bis[4-(4-hydroxyphenylsulfonyl)phenoxy-3-propyloxy]diphenylsulfone (4-4)

4,4'-bis[4-(4-hydroxyphenylsulfonyl)phenoxy-2-ethyloxy]diphenylsulfone (4-5)

4-[4-(4-hydroxyphenylsulfonyl)phenoxy-4-butyloxy]-4'-[4-(4-hydroxyphenylsulfonyl)phenoxy-3-propyloxy] diphenylsulfone (4-6)

4-[4-(4-hydroxyphenylsulfonyl)phenoxy-4-butyloxy]-4'-[4-(4-hydroxyphenylsulfonyl)phenoxy-2-ethyloxy] diphenylsulfone (4-7)

4-[4-(4-hydroxyphenylsulfonyl) phenoxy-3-propyloxy]-4'-[4-(4-hydroxyphenylsulfonyl)phenoxy-2-ethyloxy] diphenylsulfone (4-8)

4-4'-bis[4-(4-hydroxyphenylsulfonyl)phenoxy-5-pentyloxy]diphenylsulfone (4-9) 4,4'-bis[4-(4-hydroxyphenylsulfonyl)phenoxy-6-hexyloxy]diphenylsulfone (4-10)

4-[4-[4-hydroxyphenylsulfonyl]phenoxy]-2-trans-butenyloxy]-4'-[4-(4-hydroxyphenylsulfonyl)phenoxy-4-butyloxy]diphenylsulfone (4-11)

4-[4-(4-hydroxyphenylsulfonyl)phenoxy-2-trans-butenyloxy]-4'-[4-(4-hydroxyphenylsulfonyl)phenoxy-3-propyloxy]diphenylsulfone (4-12)

4-[4-[4-(4-hydroxyphenylsulfonyl)phenoxy]-2-trans-butenyloxy]-4'-[4-(4-hydroxyphenylsulfonyl)phenoxy-2-ethyloxy]diphenylsulfone (4-13)

1,4-bis[4-[4-[4-(4-hydroxyphenylsulfonyl)phenoxy-2-trans-butenyloxy]phenylsulfonyl]phenoxy]-cis-2-butene (4-14)

1,4-bis[4-[4-[4-(4-hydroxyphenylsulfonyl)phenoxy-2-trans-butenyloxy]phenylsulfonyl]phenoxy]-trans-2-butene (4-15)

4,4'-bis[4-[4-(2-hydroxyphenylsulfonyl)phenoxy] butyloxy]diphenylsulfone (4-16)

4,4'-bis[4-[2-(4-hydroxyphenylsulfonyl)phenoxy] butyloxy]diphenylsulfone (4-17)

4,4'-bis[4-(4-hydroxyphenylsulfonyl)phenoxy-2-ethylenoxyethoxy]diphenylsulfone (4-18)

4,4'-bis[4-(4-hydroxyphenylsulfonyl)phenyl-14-phenylenebismethyleneoxy]diphenylsulfone (4-19)

4,4'-bis[4-(4-hydroxyphenylsulfonyl)phenyl-1,3-phenylenebismethyleneoxy]diphenylsulfone (4-20)

4,4'-bis[4-(4-hydroxyphenylsulfonyl)phenyl-1,2-phenylenebismethyleneoxy]diphenylsulfone (4-21)

2,2'-bis[4-[4-[4-(4-hydroxyphenylsulfonyl)phenoxy-2-ethyleneoxyethoxy]phenylsulfonyl]phenoxy]diethyl ether (4-22)

α, α'-bis[4-[4-[4-(4-hydroxyphenylsulfonyl)phenyl-1,4-phenylenebismethyleneoxy]phenylsulfonyl]phenoxy]-p-xylene (4-23)

α, α'-bis[4-[4-[4-(4-hydroxyphenylsulfonyl)phenyl-1,3-phenylenebismethyleneoxy]phenylsulfonyl]phenoxy]-m-xylene (4-24)

α, α'-bis[4-[4-[4-(4-hydroxyphenylsulfonyl)phenyl-1,2-phenylenebismethyleneoxy]phenylsulfonyl]phenoxy]-o-xylene (4-25)

2,4'-bis[2-(4-hydroxyphenylsulfonyl)phenoxy-2-ethyleneoxyethoxy]diphenylsulfone (4-26)

2,4'-bis[4-(2-hydroxyphenylsulfonyl)phenoxy-2-ethyleneoxyethoxy]diphenylsulfone (4-27)

4,4'-bis[3,5-dimethyl-4-(3,5-dimethyl-4-hydroxyphenylsulfonyl)phenoxy-2-ethyleneoxyethoxy]diphenylsulfone (4-28)

4,4'-bis[3-allyl4-(3-allyl-4-hydroxyphenylsulfonyl) phenoxy-2-ethyleneoxyethoxy]diphenylsulfone (4-29)

4,4'-bis[3,5-dimethyl-4-(3,5-dimethyl-4-hydroxyphenylsulfonyl)phenyl-1,4-phenylenebismethyleneoxy]diphenylsulfone (4-30)

4,4'-bis[3,5-dimethyl-4-(3,5-dimethyl-4-hydroxyphenylsulfonyl)phenyl-1,3-phenylenebismethyleneoxy]diphenylsulfone (4-31)

4,4'-bis[3,5-dimethyl-4-(3,5-dimethyl-4-hydroxyphenylsulfonyl)phenyl-1,2-phenylenebismethyleneoxy]diphenylsulfone (4-32)

4,4'-bis[3-allyl4-(3-allyl-4-hydroxyphenylsulfonyl) 1,4-phenylenebismethyleneoxy]diphenylsulfone (4-33)

4,4'-bis[3-allyl4-(3-allyl-4-hydroxyphenylsulfonyl) 1,3-phenylenebismethyleneoxy]diphenylsulfone (4-34)

4,4'-bis[3-allyl4-(3-allyl-4-hydroxyphenylsulfonyl) 1,2-phenylenebismethyleneoxy]diphenylsulfone (4-35)

4,4'-bis[4-(4-hydroxyphenylsulfonyl)phenoxy-2-hydroxypropyloxy]diphenylsulfone (4-36)

1,3-bis[4-[4-[4-(4-hydroxyphenylsulfonyl)phenoxy-2-hydroxypropyloxy]phenylsulfonyl]phenoxy]-2-hydroxypropane.

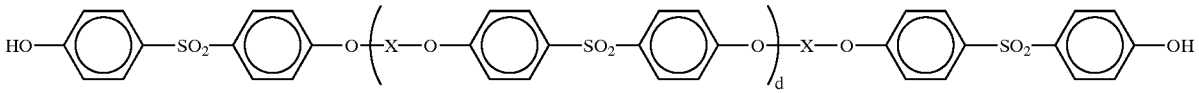

X = $CH_2CH_2OCH_2CH_2$

Further, among the compounds represented by general formula (5), the compound of d=0 is the compounds disclosed in Japanese Patent Application 7-149713, PCT Laid Open Publication WO93/06074 and WO95/33714. And concretely, 1,3-bis[4-(4-hydroxyphenylsulfonyl)phenoxy]-2-hydroxypropane, 1,1-bis[4-(4-hydroxyphenylsulfonyl)phenoxy]methane, 1,2-bis[4-(4-hydroxyphenylsulfonyl)phenoxy]ethane, 1,3-bis[4-(4-hydroxyphenylsulfonyl)phenoxy]propane, 1,4-bis[4-(4-hydroxyphenylsulfonyl)phenoxy]butane, 1,5-bis[4-(4-hydroxyphenylsulfonyl)phenoxy]pentane, 1,6-bis[4-(4-hydroxyphenyisulfonyl)phenoxy]hexane, α, α'-bis[4-(4-hydroxyphenylsulfonyl)phenoxy]-p-xylene, α, α'-bis[4-(4-hydroxyphenylsulfonyl)phenoxy]-m-xylene, α, α'-bis[4-(4-hydroxyphenylsulfonyl)phenoxy]-o-xylene, 2,2'-bis[4-(4-hydroxyphenylsulfonyl)phenoxy]diethyl ether, 4,4'-bis[4-(4-hydroxyphenylsulfonyl)phenoxy]dibuthyl ether, 1,2-bis[4-(4-hydroxyphenylsulfonyl)phenoxy]ethylene and 1,4-bis[4-(4-hydroxyphenylsulfonyl)phenoxy]-2-butene can be mentioned.

The compound represented by general formula (4) can be obtained by the method described in International Patent Laid Open Publication WO97/16420 which reacts 4,4'-dihydroxyphenylsulfone derivatives or 2,4'-dihydroxyphenylsulfone derivatives under the presence of basic compound. The compound used in this invention contains one or more kinds of diphenylsulfone bridgeable type compound prepared by above mentioned method, and the compounds obtained by following synthetic examples are desirably used.

Synthetic Example 1

16.0 g (0.4 mole) of sodium hydroxide is added to 21.2 g of water and dissolved, then 50.0 g (0.2 mole) of 4,4'-dihydroxydiphenylsulfone (BPS) is added. Then, 14.3 g (0.10 mole) of bis(2-chloroethyl)ether is added at 105° C., reacted for 5 hours at 110–115° C. After the reaction is over, 375 ml of water is added to the reacted solution, stirred for 1 hour at 90° C. Then cooled down to the room temperature, neutralized by 20% sulfuric acid. The crystallized solid is filtrated, and 39.3 g of white crystalline is obtained. The yield to bis(2-chloroethyl)ether is 88%. The obtained component is analyzed by high performance liquid chromatography and identified as follows. As the column, Mightysil RP-18 (product of Kanto Chemical Co., Ltd.) is used, and moving bed is $CH_3CN:H_2O:1\%\ H_3PO_4$=700:300:5, and UV wave length is 260 nm.

| | | | |
|---|---|---|---|
| d = 0:retention time | 1.9 | minutes:area % | 32.9 |
| d = 1:retention time | 2.3 | minutes:area % | 21.7 |
| d = 2:retention time | 2.7 | minutes:area % | 12.8 |
| d = 3:retention time | 3.4 | minutes:area % | 8.8 |
| d = 4:retention time | 4.2 | minutes:area % | 5.8 |
| d = 5:retention time | 5.4 | minutes:area % | 3.5 |
| d = 6:retention time | 7.0 | minutes:area % | 2.2 |
| d = 7:retention time | 9.0 | minutes:area % | 1.7 |
| d = 8:retention time | 11.8 | minutes:area % | 1.3 |
| d = 9:retention time | 15.4 | minutes:area % | 1.3 |

Synthetic Examples 2–4

The molar ratio of BPS and bis(2-chloroethyl)ether of Synthetic 1 is changed to 1.5:1, 2.5:1, 3.0:1, and following composition can be obtained.

Inacaseof 1.5:1, d=0 is 20.8, d=1 is 33.0, d=2 is 14.2, d=3 is 7.9, d=4 is 3.9

In a case of 2.5:1, d=0 is 49.6, d=1 is 25.9, d=2 is 11.4, d=3 is 5.3, d=4 is 2.4

In a case of 3.0:1, d=0 is 56.9, d=1 is 24.9, d=2 is 9.6, d=3 is 3.7, d=4 is 1.3

Synthetic Example 5

In a mixed solution of 10.0 g of 48% of aqueous solution of sodium hydroxide and 155 g of N,N'-dimethylacetoamide, 30.0 g (0.12 mole) of BPS is added. After temperature is risen to 80° C. and BPS is dissolved, 10.5 g (0.06 mole) of α, α'-dichloro-p-xylene dissolved in 15 g of xylene is dropped slowly. Then, ripened 2 hours by same temperature. After ripened, the solution is poured into 900 ml of water and the crystallized solid is filtrated. The obtained crude crystalline is rinsed by methanol, filtrated and dried up, and 19.7 g of white crystalline is obtained. Analyzed by high performance liquid chromatograph, and the main components are identified as follows.

| | |
|---|---|
| α,α'-bis[4-(4-hydroxyphenylsulfonyl)phenoxy]-p-xylene | 59.1% |
| 4,4'-bis[4-(4-hydroxyphenylsulfonyl)pheny-1,4-phenylenebismethyleneoxy]diphenylsulfone | 23.1% |
| α,α'-bis[4-[4-[4-(4-hydroxyphenylsulfonyl)phenyl-1,4-phenylenebismethyleneoxy]phenylsulfonyl]phenoxy]p-xylene | 11.1% |

As the leuco color developing type basic leuco dye used in this invention, all well known dye in the field of conventional pressure sensitive type or thermally sensitive type recording paper can be used, and triphenyl methane type compound, fluoran type compound, fluorene type compound or divinyl type compound are desirably used, however, not intends to be limited to them. Typical example of colorless or pale colored leuco dye (dye precursor) are mentioned below. Further, these dye precursor can be used alone or together with.

<Triphenylmethane type leuco dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran type leuco dyes>

3-diethylamno-6-methylfluoran
3-diethylamino-6-methyl-7-anilinofluoran
3-diethylamino-6-methyl-7-(o,p-dimethylanilino)fluoran
3-diethylamino-6-methyl-7-chlorofluoran
3-diethylamino-6-methyl-7-(m-trifluoromethylanilino) fluoran
3-diethylamino-6-methyl-7-(o-chloroanilino)fluoran
3-diethylamino-6-methyl-7-(p-chloroanilino) fluoran
3-diethylamino-6-methyl-7-(o-fluoroanilino)fluoran
3-diethylamino-6-methyl-7-(m-methylanilino)fluoran
3-diethylamino-6-methyl-7-n-octylanilinofluoran
3-diethylamino-6-methyl-7-n-octylaminofluoran
3-diethylamino-6-methyl-7-benzylanilinofluoran
3-diethylamino-6-methyl-7-dibenzylanilinofluoran
3-diethylamino-6-chloro-7-metnylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethylamino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino) fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-7-(m-trifluoromethylaniliono)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino) fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl) aminoanilinofluoran
2-methoxy-6-p-(p-dimethylaminophenyl) aminoanilinofluoran
2-chloro-3-methyl-6-p-(p-phenylaminophenyl) aminoanilinofluoran
2-chloro-6-p-(p-dimethylaminophenyl) aminoanilinofluoran
2-nitro-6-p-(p-diethylaminophenyl)aminoanilinofluoran
2-amino-6-p-(p-diethylaminophenyl)aminoanilinofluoran
2-diethylamino-6-p-(p-diethylaminophenyl) aminoanilinofluoran
2-phenyl-6-metyl-6-p-(p-phenylaminophenyl) aminoanilinofluoran
2-benzyl-6-p-(p-phenylaminophenyl) aminoanilinofluoran
2-hydroxy-6-p-(p-phenylaminophenyl) aminoanilinofluoran
3-methyl-6-p-(p-dimethylaminophenyl) aminoanilinofluoran
3-diethylamino-6-p-(p-diethylaminophenyl) aminoanilinofluoran 3-diethylamino-6-p-(p-dibutylaminophenyl) aminoanilinofluoran 2,4-dimethyl-6-[(4-dimethylamino)anilino]-fluoran <Fluorene type leuco dyes>

3,6,6'-tris(dimethylamino)spiro[fluorene-9,3'-phthalide]

3,6,6'-tris(diethylamino)spiro[fluorene-9,3'-phthalide]

<Divinyl type leuco dyes>

3,3-bis-[2-(p-dimethylaminophenyl)-2-(p-methoxyphenyl)ethenyl]-4,5,6,7-tetrabromophthalide 3,3-bis-[2-(p-dimethylaminophenyl)-2-(p-methoxyphenyl)ethenyl]-4,5,6,7-tetrachlorophthalide 3,3-bis-[1,1-bis(4-pyrrolidinophenyl)ethylen-2-yl]-4,5,6,7-tetrabromophthalide 3,3-bis-[1-(4-methoxyphenyl)-1-(4-pyrrolidinophenyl) ethylene-2-yl]4,5,6,7-tetrachlorophthalide <Others>

3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluoran-γ-(3'-nitro)anilinolactam 3,6-bis(diethylamino)fluoran-γ-(4'-nitro)anilinolactam 1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-2-β-naphthoyl ethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonicacid dimethylester.

Among these compounds, especially, 3-di-n-pentylamino-6-methyl-7-anilinofluoran is desirably used because whiteness of ground color and heat resistance are good. In general, it is concerned that the coloring of the coating is caused as follows. Namely, a part of materials contained in coating is dissolved in water, and it reacts with dye. For example, 4,4'-dihydroxy diphenylsulfone, which is a kind of compound represented by general formula (1) contains two —OH groups by which basic colorless dye is color developed, and is easily dissolved in water. In the meanwhile, since the degree of solubility to water of 3-di-n-pentylamino-6-methyl-7-anilinofluoran is lower than $1.349\times10^{-6}$ g/l, which is recognized as very low level, it is possible to prevent the coloring of the coating by the together use of 3-di-n-pentylamino-6-methyl-7-anilinofluoran with compound represented by general formula (1).

In the present invention, the well known conventional sensitized can be used in the limitation not to prevent the desirable effect to said object. As the concrete example, ethylenebisamide, montan acid wax, polyethylene wax, 1,2-di-(3-methylphenoxy)ethane, p-benzilbiphenyl, β-benzyloxynaphthalene, 4-biphenyl-p-tolylether, m-tarphenyl, 1,2-diphenoxyethane, dibenzyl4,4'-ethylenedioxy-bis-benzoate, dibenzoyloxymethane, 1,2-di(3-methylphenoxy)ethylene, 1,2-diphenoxyethylene, bis[2-(4-methoxy-phenoxy)]ethyl]ether, p-nitromethylbenzoate, dibenzyl oxalate, di(p-chloro benzyl) oxalate, di(p-methyl benzyl) oxalate, dibenzylterephthalate, benzyl p-benzyloxybenzoate, di-p-tolyl carbonate, phenyl-α-naphthylcarbonate, 1,4-diethoxy naphthalene, phenyl 1-hydroxy-2-naphthoate, o-xylene-bis-(phenylether), 4-(m-methylphenoxymethyl)biphenyl, o-toluenesulfoneamide and p-toluenesulfoneamide can be mentioned, however, not intends to be limited to them. These kinds of sensitizer can be used alone or can be used together with.

As the binder to be used in the present invention, full saponificated polyvinyl alcohol of 200–1900 polymerization degree, partial saponificated polyvinyl alcohol, denatured polyvinyl alcohol by carboxyl, denatured polyvinyl alcohol by amide denatured polyvinyl alcohol by sulfonic acid denatured polyvinyl alcohol by butylal modified polyvinyl alcohol, derivatives of cellulose such as hydroxyethyl cellulose, methyl cellulose, ethyl cellulose, carboxymethyl cellulose and acetyl cellulose, copolymer of styrene-maleic unhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be illustrated. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

And in this invention, as the image stabilizer showing oil resistance effect of recorded image, 4,4'-buthylidene(6-t-buthyl-3-methylphenol), 2,2'-di-t-buthyl-5,5'-dimethyl-4,4'-sulphonyldiphenol, 1,1,3-tris(2-methyl-4-hydroxy-5-cyclohexylphenyl) buthane and 1,1,3-tris(2-methyl-4-hydroxy-5-t-buthylphenyl) buthane 4-benzyloxy-4'-(2,3-epoxy-2-methylpropoxy) diphenylsulfone and epoxy resin can be added in the limit not to prevent above mentioned desired effect.

As a filler which can be used in this invention, an inorganic or an organic filler such as silica, calcium carbonate, kaoline, calcined kaoline, diatomaceous earth, talc, titanium oxide or aluminum hydroxide can be mentioned. Further, a slipping agent such as waxes, an ultra violet ray absorbing agent such as benzophenone type or triasol type compound, a water proof agent such as glioxasal, a dispersing agent, a defoamer, an anti oxidation agent and fluoresene dye can be used.

The amount of color developer and dye precursor, the kind and amount of other additives to be used to the thermal recording material of this invention are decided according to the required quality and recording feature, and not restricted. However, in general, it is preferable to use 0.1–2 parts of basic leuco dye and 0.5–4 parts of filler to 1 part of color developing agent indicated by general formula (1) are used. And the desirable amount of binder is 5–25% to the total amount of solid.

The coating of above mentioned component is coated over the surface of substrate such as paper, recycled paper, synthetic paper, film, plastic film, plastic foam film or non-woven cloth, and the desired thermal recording material can be obtained. The complex sheet composed of above mentioned sheet can also be used.

Further, to improve the preservative property, an overcoat layer can be prepared on the th ermally sensitive color developing layer. Said organic color developer, basic leuco dye and other additives which are added at need are ground to the fine particles smaller than several microns diameter by means of a pulverizer such as a ball mill, an attriter or a sand grinder, or by means of an adequate emulsifying apparatus, then binder and other additives are added at need, thus the coating is prepared. The method to coat is not restricted, and can be coated by conventional well known methods, for example, an off machine coating machine with various coater such as air knife coater, rod blade coater, bill blade coater or roll coater, or an on machine coating machine can preferably used.

EXAMPLE

The thermal recording material of this invention will be illustrated more concretely by Examples, however, not intended to be limited to them. In the Examples and Comparative Examples, "parts" indicates weight part.

Example 1

According to the following recipe, dispersions of dye, color developing agent and sensitizer are separately ground in wet condition to average particle diameter of 0.5 $\mu$m by a sand grinder.

| | |
|---|---|
| <dispersion of color developing agent> | |
| 4,4'-dihydroxydiphenylsulfone (1-1) | 6.0 parts |
| 10% aqueous solution of polyvinyl alcohol | 18.8 parts |
| water | 11.2 parts |
| <dispersion of dye> | |
| 3-di-n-buthylamino-6-methyl-7-anilinofluoran (ODB2) | 3.0 parts |
| 10% aqueous solution of polyvinyl alcohol | 6.9 parts |
| water | 3.9 parts |
| <dispersion of fatty acid monoamide> | |
| (2-3) compound | 12.0 parts |
| 10% aqueous solution of polyvinyl alcohol | 37.6 parts |
| water | 22.4 parts |

The compounds mentioned below are mixed and the coating for thermally sensitive layer is prepared. The obtained coating is coated over the surface of 50 g/m$^2$ high grade paper and dried up so as to the coating amount is 6.0 g/m$^2$, and the obtained sheet is treated by a super calendar so as the Beck's smoothness become 200–600 sec. and the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 72.0 parts |
| 50% dispersion of kaolin clay | 26.0 parts |
| 30% dispersion of zinc stearate | 6.7 parts |

Example 2

By same process to Example 1 except changing the blending ratio of fatty acid monoamide dispersion as mentioned below, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 54.0 parts |
| 50% dispersion of kaolin clay | 26.0 parts |
| 30% dispersion of zinc stearate | 6.7 parts |

Example 3

By same process to Example 1 except changing the blending ratio of fatty acid monoamide dispersion as mentioned below, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 63.0 parts |
| 50% dispersion of kaolin clay | 26.0 parts |
| 30% dispersion of zinc stearate | 6.7 parts |

Example 4

By same process to Example 1 except changing the blending ratio of fatty acid monoamide dispersion as mentioned below, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 126.0 parts |
| 50% dispersion of kaolin clay | 26.0 parts |
| 30% dispersion of zinc stearate | 6.7 parts |

Examples 5, 6

By same process to Example 1 except changing ODB2 of dye dispersion to 3-di-n-pentylamino-6-methyl-7-anilinofluoran (commercial name : Black305, product of Yamada Chemical Industries; hereinafter shortened to B305) (Example 5), 3-(N-ethyl-N-isoamylamino)-6-methyl-7-anilinofluoran (S205) (Example 6), the thermally sensitive recording media are obtained.

Example 7

By same process to Example 1 except changing (1-1) compound of color developing agent dispersion to (1-2) compound, the thermal recording material is obtained.

Example 8

By same process to Example 1 except changing (2-3) compound of fatty acid monoamide dispersion to (2-2) compound, the thermal recording material is obtained.

Example 9

By same process to Example 1 except changing (2-3) compound of fatty acid monoamide dispersion as follows, the thermal recording material is obtained.

| <dispersion of fatty acid monoamide> | |
|---|---|
| (2-3) compound | 8.4 parts |
| (2-2) compound | 3.6 parts |
| 10% aqueous solution of polyvinyl alcohol | 37.6 parts |
| water | 22.4 parts |

Example 10

According to the following recipe, dispersions of following materials are prepared and are ground in wet condition to average particle diameter of 0.5 $\mu$m by a sand grinder.

| <dispersion of stabilizer> | |
|---|---|
| 4-benzyloxy-4'-(2,3-epoxy-2-methylpropoxy)diphenylsulfone (commercial name: NTZ-95, product of Nihon Soda; hereinafter shortened to NTZ) | 1.0 parts |
| 10% aqueous solution of polyvinyl alcohol | 3.1 parts |
| water | 1.9 parts |

By same process to Example 5 except adding dispersion of stabilizer, the thermal recording material of following recipe is obtained.

| | |
|---|---|
| dispersion of color developing agent | 36.0 parts |
| dispersion of dye | 13.8 parts |
| dispersion of fatty acid monoamide | 72.0 parts |
| dispersion of stabilizer | 6.0 parts |
| 50% dispersion of kaolin clay | 12.0 parts |
| 30% dispersion of zinc stearate | 6.7 parts |

Example 11

By same process to Example 10 except changing the blending ratio of stabilizer dispersion as mentioned below, the thermal recording material is obtained.

| | |
|---|---|
| dispersion of color developing agent | 36.0 parts |
| dispersion of dye | 13.8 parts |
| dispersion of fatty acid monoamide | 72.0 parts |
| dispersion of stabilizer | 18.0 parts |
| 50% dispersion of kaolin clay | 12.0 parts |
| 30% dispersion of zinc stearate | 6.7 parts |

Example 12

By same process to Example 10 except changing the blending ratio of stabilizer dispersion as mentioned below, the thermal recording material is obtained.

| | |
|---|---|
| dispersion of color developing agent | 36.0 parts |
| dispersion of dye | 13.8 parts |

-continued

| | |
|---|---|
| dispersion of fatty acid monoamide | 72.0 parts |
| dispersion of stabilizer | 0.6 parts |
| 50% dispersion of kaolin clay | 12.0 parts |
| 30% dispersion of zinc stearate | 6.7 parts |

Examples 13,14

By same process to Example 10 except changing NTZ of stabilizer dispersion to copolymer of glycidilmethacrylate and vinyl monomer (average molecular weight is 11000, epoxy equivalent is 312, melting point is lower than 110° C.) (commercial name: NER-064, product of NAGASE KASEI; hereinafter shortened to NER) (Example 13) and to diphenylsulfone bridgeable type compound of Synthetic Example 1 (Example 14), the thermally sensitive recording media are obtained.

Example 15

According to the following recipe, dispersions of following materials are prepared and are ground in wet condition to average particle diameter of 0.5 $\mu$m by a sand grinder.

| <dispersion of diphenylsulfone> | |
|---|---|
| (3-1) compound | 9.0 parts |
| 10% aqueous solution of polyvinyl alcohol | 28.2 parts |
| water | 16.8 parts |

By same process to Example 1 except changing blending amount of dispersion of fatty acid amide and adding dispersion of diphenylsulfone, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 18.0 parts |
| dispersion of diphenylsulfone((3-1) compound) | 54.0 parts |
| 50% dispersion of kaolin clay | 26.0 parts |
| 30% dispersion of zinc stearate | 6.7 parts |

Example 16

By same process to Example 15 except changing blending amount of fatty acid amide dispersion and diphenylsulfone dispersion, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 36.0 parts |
| dispersion of diphenylsulfone((3-1) compound) | 36.0 parts |
| 50% dispersion of kaolin clay | 26.0 parts |
| 30% dispersion of zinc stearate | 6.7 parts |

Examples 17,18

By same process to Example 16 except changing ODB2 to B305 (Example 17) and to S205 (Example 18), the thermally sensitive recording media are obtained.

Example 19

By same process to Example 15 except changing blending amount of fatty acid amide dispersion and diphenylsulfone dispersion, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 54.0 parts |
| dispersion of diphenylsulfone((3-1) compound) | 18.0 parts |
| 50% dispersion of kaolin clay | 26.0 parts |
| 30% dispersion of zinc stearate | 6.7 parts |

Example 20

By same process to Example 15 except changing blending amount of fatty acid amide dispersion and diphenylsulfone dispersion, the thermal recording material of following recipe is obtained.

| | |
|---|---|
| dispersion of color developing agent ((1-1) compound) (amount of solid is 7.88 parts) | 36.0 parts |
| dispersion of dye (ODB2) (amount of solid is 3.69 parts) | 13.8 parts |
| dispersion of fatty acid monoamide ((2-3) compound) (amount of solid is 15.76 parts) | 72.0 parts |
| dispersion of diphenylsulfone ((3-1) compound) (amount of solid is 1.97 parts; amount of solid diphenylsulfone is 1.5 parts) | 9.0 parts |
| 50% dispersion of kaolin clay (amount of solid is 13 parts) | 26.0 parts |
| 30% dispersion of zinc stearate (amount of solid is 2.01 parts) | 6.7 parts |

Example 21

By same process to Example 17 except adding dispersion of stabilizer used in Example 10, the thermal recording material of following recipe is obtained.

| | |
|---|---|
| dispersion of color developing agent | 36.0 parts |
| dispersion of dye | 13.8 parts |
| dispersion of fatty acid monoamide | 36.0 parts |
| dispersion of diphenylsulfone | 36.0 parts |
| dispersion of stabilizer | 6.0 parts |
| 50% dispersion of kaolin clay | 12.0 parts |
| 30% dispersion of zinc stearate | 6.7 parts |

Examples 22, 23

By same process to Example 21 except changing NTZ to NER (Example 22) and to diphenylsulfone type bridgeable compound of Synthetic Example 1 (Example 23), the thermally sensitive recording media are obtained.

Comparative Example 1

By same process to Example 1 except changing (1-1) compound of color developing agent dispersion to 4,4'-isopropyridendiphenol (BPA), the thermal recording material is obtained.

Comparative Example 2

By same process to Example 1 except changing the blending ratio of fatty acid monoamide dispersion as mentioned below, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 36.0 parts |
| 50% dispersion of kaolin clay | 26.0 parts |
| 30% dispersion of zinc stearate | 6.7 parts |

Comparative Example 3

By same process to Example 1 except changing the blending ratio of fatty acid monoamide dispersion as mentioned below, the thermal recording material is obtained.

| | |
|---|---|
| dispersion of color developing agent ((1-1) compound) | 36.0 parts |
| dispersion of dye (ODB2) | 13.8 parts |
| dispersion of fatty acid monoamide ((2-3) compound) | 216.0 parts |
| 50% dispersion of kaolin clay | 26.0 parts |
| 30% dispersion of zinc stearate | 6.7 parts |

Comparative Example 4

By same process to Example 1 except changing fatty acid monoamide dispersion as follows, the thermal recording material is obtained.

| <dispersion of p-benzylbiphenyl> | |
|---|---|
| p-benzylbiphenyl | 12.0 parts |
| 10% aqueous solution of polyvinyl alcohol | 37.6 parts |
| water | 22.4 parts |

Comparative Example 5

By same process to Example 1 except blending following dispersion instead of fatty acid monoamide dispersion, the thermal recording material is obtained.

| <dispersion of diphenylsulfone> | |
|---|---|
| (3-1) compound | 6.0 parts |
| 10% aqueous solution of polyvinyl alcohol | 18.8 parts |
| water | 11.2 parts |

Comparative Example 6

By same process to Example 1 except blending following dispersion instead of fatty acid monoamide dispersion, the thermal recording material is obtained.

| <dispersion of polyethylene wax> | |
|---|---|
| polyethylene wax | 12.0 parts |
| 10% aqueous solution of polyvinyl alcohol | 37.6 parts |
| water | 22.4 parts |

Comparative Example 7

By same process to Example 1 except blending following dispersion instead of fatty acid monoamide dispersion, the thermal recording material is obtained.

| <dispersion of oxalic acid di(p-methylbenzyl)> | |
|---|---|
| oxalic acid di(p-methylbenzyl) | 12.0 parts |
| 10% aqueous solution of polyvinyl alcohol | 37.6 parts |
| water | 22.4 parts |

Comparative Example 8

By same process to Comparative Example 5 except adding following stabilizer dispersion, the thermal recording material is obtained.

| | |
|---|---|
| 4-benzyloxy-4'-(2,3-epoxy-2-methylpropoxy)diphenylsulfone (commercial name: NTZ-95, product of Nihon Soda) | 1.0 parts |
| 10% aqueous solution of polyvinyl alcohol | 3.1 parts |
| water | 1.9 parts |

Color Developing Sensitivity

Thermal recording is carried out on the prepared thermally sensitive recording media using TH-PMD, which is a product of Ohkura Denki Co., by 0.22 mJ/dot impressive energy. Further, printing test is carried out by UBI printer (product of UBI Co.,) by 24 mj/mm$^2$ impressive energy. Image density after printing and after quality test are measured by means of a Macbeth densitometer (umber filter used).

Degree of Whiteness of Ground Color

Degree of whiteness of not color developed portion of specimen is meadured by Hunter Whiteness tester (product of Toyo Seiki Seisakusho, blue filter). Bigger value indicates good result.

Heat Resistance Test

The specimen not color developed is left in the atmosphere of 60° C. for 24 hrs, and measured by a Hunter Whiteness tester (product of Toyo Seiki Seisakusho, blue filter).

Image Reminding Ratio After Humidity Resistance Test

Specimen of printed image using UBI printer (product of UBI Co.,) by 24 mJ/mm$^2$ impressive energy is treated in the atmosphere of 40° C., 90% condition for 24 hrs, and measured by a Macbeth densitometer. Image reminding ratio is calculated from Machbeth density of before and after treatment, using following numerical formula.

$$\text{Image reminding ratio}(\%)=[(\text{Machbeth density after treatment})/(\text{Machbeth density before treatment})]\times 100$$

Image Reminding Ratio After Plasticizer Resistance Test

A single sheet of polyvinylchloride wrap (HIGHWRAP KMA: Mitsui Toatsu Chemicals Co., Ltd.) was wound round with 1 plie on a paper tube, stuck thereon a thermal recording medium recorded by TH-PMD, which is a product of Ohkura Denki Co., by 0.22 mJ/dot impressive energy, further wound round with 3 plies of the polyvinylchloride wrap, allowed to stand at 20° C. for 24 hours, and measured by a Macbeth densitometer. Image reminding ratio is calculated from Machbeth density of before and after treatment, using above mentioned numerical formula.

Image Reminding Ratio After Heat Resistance Test

Specimen of printed image using TH-PMD, which is a product of Ohkura Denki Co., by 0.22 mJ/dot impressive energy is left in the atomosphere of 60° C. for 24 hrs. Image reminding ratio is calculated from Machbeth density of before and after treatment, using above mentioned numerical formula.

Powder Generation

Specimen of printed image using TH-PMD, which is a product of Ohkura Denki Co., by 0.22 mJ/dot impressive energy is left for 1 month, and powder generation at image part by lower energy is inspected by the naked eye of inspector. And, specimen printed by UBI printer (product of UBI Co.,) by 24 mJ/mm$^2$ impressive energy is left for 24 hrs, and powder generation at image part by higher energy is inspected by the naked eye of inspector.

○ no powder generation

Δ slightly powder generated x powder generated

The test results are summarized in Tables 1–4. In Tables 1 and 2, FMA: indicates saturated fatty acid monoamide, DPS: indicates diphenylsulfone derivatives, Numerical number in parenthesis indicates blending parts to 1 part of color developing agent.

TABLE 1

| Example | color devoloping agent | FMA | DPS | dye | stabilizer |
|---|---|---|---|---|---|
| 1 | 1-1 | 2-3 (2) | | ODB2 | |
| 2 | 1-1 | 2-3 (1.5) | | ODB2 | |
| 3 | 1-1 | 2-3 (1.75) | | ODB2 | |
| 4 | 1-1 | 2-3 (3.5) | | ODB2 | |
| 5 | 1-1 | 2-3 (2) | | B305 | |
| 6 | 1-1 | 2-3 (2) | | S205 | |
| 7 | 1-2 | 2-3 (2) | | ODB2 | |
| 8 | 1-1 | 2-2 (2) | | ODB2 | |
| 9 | 1-1 | 2-3 (1)<br>2-2 (1) | | ODB2 | |
| 10 | 1-1 | 2-3 (2) | | B305 | NTZ (0.17) |
| 11 | 1-1 | 2-3 (2) | | B305 | NTZ (0.5) |
| 12 | 1-1 | 2-3 (2) | | B305 | NTZ (0.017) |
| 13 | 1-1 | 2-3 (2) | | B305 | NER (0.17) |
| 14 | 1-1 | 2-3 (2) | | B305 | Synthetic Ex. 1 (0.17) |

TABLE 1-continued

| Example | color devoloping agent | FMA | DPS | dye | stabilizer |
|---|---|---|---|---|---|
| 15 | 1-1 | 2-3 (0.5) | 3-1 (1.5) | ODB2 | |
| 16 | 1-1 | 2-3 (1) | 3-1 (1) | ODB2 | |
| 17 | 1-1 | 2-3 (1) | 3-1 (1) | B305 | |
| 18 | 1-1 | 2-3 (1) | 3-1 (1) | S205 | |
| 19 | 1-1 | 2-3 (1.5) | 3-1 (0.5) | ODB2 | |
| 20 | 1-1 | 2-3 (2) | 3-1 (0.25) | ODB2 | |
| 21 | 1-1 | 2-3 (1) | 3-1 (1) | B305 | NTZ (0.17) |
| 22 | 1-1 | 2-3 (1) | 3-1 (1) | B305 | NER (0.17) |
| 23 | 1-1 | 2-3 (1) | 3-1 (1) | B305 | Synthetic Ex. 1 (0.17) |

TABLE 2

| Comparative Example | color developing agent | FMA | DPS | dye | stabilizer |
|---|---|---|---|---|---|
| 1 | BPA | 2-3 (2) | | ODB2 | |
| 2 | 1-1 | 2-3 (1) | | ODB2 | |
| 3 | 1-1 | 2-3 (6) | | ODB2 | |
| 4 | 1-1 | PBB (2) | | ODB2 | |
| 5 | 1-1 | | 3-1 (1) | ODB2 | |
| 6 | 1-1 | polyethylene wax (2) | | ODB2 | |
| 7 | 1-1 | oxalic acid di(p-methylbenzyl) (2) | | ODB2 | |
| 8 | 1-1 | | 3-1 (1) | ODB2 | NTZ (0.17) |

TABLE 3

| | sensitivity | | degree | ground color heat | Image reminding ratio | | | powder generation | |
|---|---|---|---|---|---|---|---|---|---|
| | 0.22 | 24 | of white- | resistance | after resistance test to | | | 0.22 | 24 |
| Example | mJ/dot | mJ/mm$^2$ | ness | 60° C. | humidity | plasticizer | heat | mJ/dot | mJ/mm$^2$ |
| 1 | 0.58 | 1.39 | 80% | 76% | 72% | 5% | 51% | ○ | ○ |
| 2 | 0.52 | 1.40 | 80% | 76% | 72% | 5% | 47% | ○ | ○ |
| 3 | 0.55 | 1.40 | 80% | 76% | 72% | 5% | 49% | ○ | ○ |
| 4 | 0.63 | 1.35 | 80% | 76% | 70% | 5% | 64% | ○ | ○ |
| 5 | 0.58 | 1.39 | 82% | 82% | 70% | 5% | 51% | ○ | ○ |
| 6 | 0.65 | 1.39 | 76% | 73% | 84% | 5% | 52% | ○ | ○ |
| 7 | 0.62 | 1.42 | 80% | 75% | 63% | 5% | 53% | ○ | ○ |
| 8 | 0.62 | 1.44 | 80% | 76% | 72% | 5% | 52% | ○ | ○ |
| 9 | 0.64 | 1.44 | 80% | 76% | 72% | 5% | 51% | ○ | ○ |
| 10 | 0.55 | 1.36 | 82% | 82% | 80% | 26% | 96% | ○ | ○ |
| 11 | 0.49 | 1.34 | 82% | 80% | 92% | 53% | 100% | ○ | ○ |
| 12 | 0.59 | 1.38 | 82% | 82% | 74% | 7% | 65% | ○ | ○ |
| 13 | 0.55 | 1.37 | 82% | 82% | 79% | 19% | 95% | ○ | ○ |
| 14 | 0.55 | 1.35 | 82% | 82% | 73% | 48% | 88% | ○ | ○ |
| 15 | 0.62 | 1.39 | 80% | 76% | 84% | 5% | 46% | ○ | Δ |
| 16 | 0.64 | 1.4 | 80% | 76% | 81% | 5% | 46% | ○ | Δ |
| 17 | 0.64 | 1.4 | 82% | 82% | 81% | 5% | 46% | ○ | Δ |
| 18 | 0.75 | 1.4 | 76% | 73% | 89% | 5% | 47% | ○ | Δ |
| 19 | 0.64 | 1.4 | 80% | 76% | 76% | 5% | 45% | ○ | Δ |
| 20 | 0.65 | 1.38 | 80% | 76% | 72% | 5% | 50% | ○ | ○ |
| 21 | 0.61 | 1.37 | 82% | 80% | 91% | 26% | 91% | ○ | Δ |
| 22 | 0.61 | 1.38 | 82% | 80% | 90% | 19% | 90% | ○ | Δ |
| 23 | 0.61 | 1.36 | 82% | 81% | 84% | 48% | 83% | ○ | Δ |

TABLE 4

| | sensitivity | | degree | ground color heat | Image reminding ratio | | | powder generation | |
|---|---|---|---|---|---|---|---|---|---|
| Comp. | 0.22 | 24 | of white- | resistance | after resistance test to | | | 22 | 24 |
| Example | mJ/dot | mJ/mm$^2$ | ness | 60° C. | humidity | plasticizer | heat | mJ/dot | mJ/mm$^2$ |
| 1 | 0.59 | 1.4 | 69% | 60% | 93% | 5% | 50% | ○ | ○ |
| 2 | 0.40 | 1.41 | 80% | 76% | 72% | 5% | 43% | ○ | ○ |
| 3 | 0.44 | 1.03 | 80% | 75% | 65% | 5% | 41% | ○ | ○ |
| 4 | 0.83 | 1.36 | 69% | 60% | 74% | 5% | 44% | Δ | Δ |
| 5 | 0.34 | 1.39 | 80% | 76% | 88% | 5% | 43% | X | X |
| 6 | 0.15 | 1.07 | 80% | 76% | 71% | 5% | 40% | ○ | ○ |
| 7 | 0.34 | 1.28 | 80% | 76% | 62% | 5% | 46% | ○ | ○ |
| 8 | 0.31 | 1.35 | 80% | 74% | 98% | 26% | 88% | X | X |

As clearly understand from above mentioned results, Examples 1–23, which contain saturated fatty acid monoamide and/or diphenylsulfone derivatives in thermally sensitive layer are excel in qualities such as color developing sensitivity, degree of whiteness of ground color, heat resistance, image reminding ratio and powder generation. Especially, Examples 1–14 which contain 1.5–5 parts of saturated fatty acid monoamide to 1 part of color developing agent are excel in controlling powder generation, further have good color developing sensitivity, heat resistance and image reminding ratio. Examples 15–19, 21–23 which contain 0.5–1.5 parts of saturated fatty acid monoamide and diphenylsulfone derivatives to 1 part of color developing agent are especially excel in color developing sensitivity, and also have good heat resistance and image preserve ability. Example 20 whose content of diphenylsulfone is smaller than 4% in solid part of thermally sensitive coating is excel in controlling powder generation, further have good color developing sensitivity, heat resistance and image reminding ratio. Further, Examples 5, 10–14, 17, 21–23 which use B305 as dye are superior to other Examples which use other kinds of dye in whiteness of ground color and in heat resistance. In Examples 10–14, 21–23 which contain a stabilizer, the image preserve ability is preferably improved. Especially, when the amount of stabilizer is bigger than 0.17 parts to 1 part of color developing agent, the improvement of image preserve ability to a plasticizer is remarkable.

In the meanwhile, by Comparative Examples 1–7 which do not meet to the important point of this invention, products that have good quality can not be obtained. Comparative Example 1, which does not use the color developing agent regulated in this invention has a problem in heat resistance. Comparative Examples 2 and 3 whose containing amount of saturated fatty acid monoamide are out of the limit prescribed in this invention have a problem in color developing sensitivity. Comparative Examples 4–7 which use different type of sensitizer from this invention have problems in all qualities. Comparative Example 8, which uses different type of sensitizer from this invention together with a stabilizer, indicates good image reminding ratio, however, is inferior in other qualities.

Possibility to be Used in an Industrial Scale

Since the thermal recording material of this invention is excel in color density, ground color, heat resistance, image reminding ratio and preventing ability of powder generation, can be used as a facsimile paper, printing paper, register paper and thermally sensitive paper, and can provide a high quality and reliable thermal recording material.

What is claimed is:

1. A thermal recording material comprising a thermally sensitive color developing layer containing colorless or pale colored basic dye and an organic color developing agent as a main component on a substrate, wherein said thermally sensitive recording layer contains at least one kind of dihydroxydiphenylsulfon type compound represented by general formula (1) as an organic color developing agent, further contains at least one kind of saturated fatty acid monoamide represented by general formula (2) and at least one kind of diphenylsulfone derivatives represented by general formula (3),

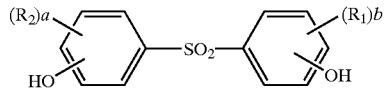

(1)

wherein, $R_1$ and $R_2$ indicate an alkyl group or an alkenyl group of carbon number 1–8, or a halogen atom and a and b is an integer number of 0–3, $$R_3—CONH_2 \quad (2)$$

wherein, $R_3$ indicates an alkyl group of carbon number 11–21.

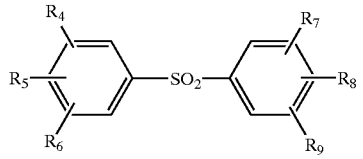

(3)

wherein $R_4$–$R_9$ indicate a hydrogen atom, an alkyl group, a halogen atom, a nitro group, an alkoxy group, a cyano group or an allyloxy group.

2. The thermal recording material of claim 1, wherein the colorless or pale colored basic dye is 3-di-n-penthylamino-6-methyl-7-anilinofluorane.

3. The thermal recording material of claim 2 further containing at least one compound selected from the group composed of 4-benzyloxy-4'-(2,3-epoxy-2-methylpropoxy) dephenylsulfone, epoxy resin and diphenyl sulfone bridgeable type compound represented by general formula (4),

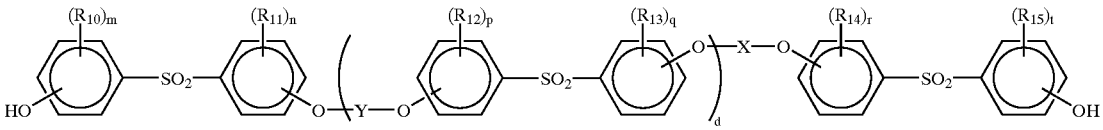

(4)

wherein, X and Y can be different and indicate a saturated or an unsaturated liner or grafted hydrocarbon group of carbon number 1–12 which can possess an ether bond, or indicate (a)

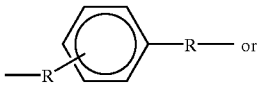

(b)

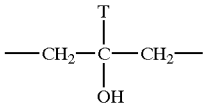

wherein, R indicates a methylene group or an ethylene group, T indicates a hydrogen atom or an alkyl group of carbon number 1–4, and $R_{10}$–$R_{15}$ independently indicate a halogen atom, an alkyl group of carbon number 1–6, or an alkenyl group, further, m, n, p, q, r, t indicate an integer number of 0–4 and when are bigger than 2, $R_{10}$–$R_{15}$ can be different, and d is an intger of 0–10.

4. The thermal recording material according to claim 1, further containing at least one compound selected from the group composed of 4-benzyloxy-4'-(2,3-epoxy-2-methylpropoxy)dephenylsulfone, epoxy resin and diphenyl sulfone bridgeable type compound represented by general formula (4), (4)

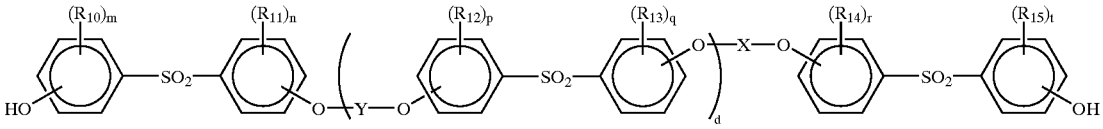

wherein, X and Y can be different and indicate a saturated or an unsaturated liner or grafted hydrocarbon group of carbon number 1–12 which can possess an ether bond, or indicate (a)

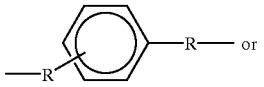

(b)

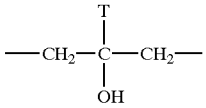

wherein, R indicates a methylene group or an ethylene group, T indicates a hydrogen atom or an alkyl group of carbon number 1–4, and $R_{10}$–$R_{15}$ independently indicate a halogen atom, an alkyl group of carbon number 1–6, or an alkenyl group, further, m, n, p, q, r, t indicate an integer number of 0–4 and when are bigger than 2, $R_{10}$–$R_{15}$ can be different, and d is an integer of 0–10.

* * * * *